US008203090B2

(12) United States Patent
King

(10) Patent No.: US 8,203,090 B2
(45) Date of Patent: Jun. 19, 2012

(54) SWITCH ASSEMBLY

(75) Inventor: Corey T. King, Snohomish, WA (US)

(73) Assignee: King Enterprises, Snohomish, WA (US)

( * ) Notice: Subject to any disclaimer, the term of this patent is extended or adjusted under 35 U.S.C. 154(b) by 301 days.

(21) Appl. No.: 12/436,669

(22) Filed: May 6, 2009

(65) Prior Publication Data

US 2010/0276267 A1 Nov. 4, 2010

Related U.S. Application Data

(60) Provisional application No. 61/174,835, filed on May 1, 2009.

(51) Int. Cl.
*H01H 9/02* (2006.01)

(52) U.S. Cl. ..... 200/303; 200/61.81; 200/61.93

(58) Field of Classification Search ..... 200/303, 200/293, 16 B, 61.81–61.82, 61.93; 361/807, 361/810

See application file for complete search history.

(56) References Cited

U.S. PATENT DOCUMENTS 2,626,336 A 1/1953 Chute
3,190,982 A 6/1965 Woodcock
3,653,022 A 3/1972 Tall
3,676,570 A * 7/1972 Gabb ..... 174/61
3,809,838 A * 5/1974 Coppola ..... 200/532
4,258,359 A 3/1981 McLamb
4,303,815 A * 12/1981 Ishikawa ..... 200/330
4,426,126 A * 1/1984 De Vos et al. ..... 439/572
4,533,904 A 8/1985 Steinman, Jr.
4,599,498 A 7/1986 Shimoya
5,072,211 A 12/1991 Clement
5,229,545 A * 7/1993 Good ..... 174/542
5,272,605 A * 12/1993 Johnstone ..... 362/147
6,791,046 B1 9/2004 King
7,116,224 B2 10/2006 Mickler

* cited by examiner

*Primary Examiner* — Xuong Chung Trans
(74) *Attorney, Agent, or Firm* — Christensen O'Connor Johnson Kindness PLLC

(57) ABSTRACT

A switch assembly having a housing with a lower housing portion removably securable to an upper housing portion is provided. A switch subassembly including a printed circuit board (PCB) is removably secured within the lower housing portion. A mechanical switch assembly and a sensor are electrically connected to the PCB, and the PCB includes circuitry to place each of the mechanical switch assembly and the sensor into electrical communication with an external source. The switch assembly further includes a plunger engageable with the mechanical switch assembly.

An attachment assembly for securing the upper housing portion to a mounting structure includes a mounting plate securable to the mounting structure, wherein the mounting plate includes at least one threaded opening. At least one opening is formed in the upper housing portion that is alignable with the threaded opening in the mounting plate that is sized and configured to receive a fastener.

20 Claims, 7 Drawing Sheets

SWITCH ASSEMBLY

CROSS-REFERENCE TO RELATED APPLICATION

This application claims the benefit of U.S. Provisional Application No. 61/174,835, filed May 1, 2009, the disclosure of which is hereby expressly incorporated by reference.

BACKGROUND

A typical home or bank alarm system may be comprised of switch assemblies and other triggering devices integrated within protected areas or devices, such as a bank safe, vault, ATM, or night depository. The switch assemblies may be connected to an alarm sounding device, a camera, a system for notifying the police, etc. ("alarms"). Disturbance of or unauthorized penetration through the protected areas or devices automatically causes the switch assemblies to open or close, which triggers the alarm(s) until they are stopped by deactivation of the switch assembly (for example, through a key control, by the entry of a code in the possession of the alarm system user, by exhaustion of the power supply, by a timing element set for a definite period of operation, etc.).

A bank alarm system may include a variety of different switch assemblies suitable for different devices and applications. For instance, the alarm system may include a pushbutton switch assembly at each teller station that triggers an alarm or turns on a camera when a pushbutton is depressed. The pushbutton switch assembly may include a pair of switches that are placed opposite one another within a single case or housing such that a person would normally have to use two fingers to activate the alarm. In this manner, if one switch is accidentally pushed, the alarm will not sound. Such switches and their associated housing are generally referred to as "two-finger switches."

The bank alarm system may further include a switch assembly that serves as a back-up or secondary precaution to protect the contents of a safe or other lockable and securable container. Various switch assemblies are available that may be used in combination with the locking mechanism to alert an entity to the unauthorized opening of the safe. For instance, the safe switch assembly may include a heat sensor that triggers an alarm when an intruder is attempting to open the safe door or otherwise destroy the lock of the safe with, for instance, a torch. The safe switch assembly may instead include a mechanical switch that triggers an alarm when the safe door is opened a predetermined amount. The safe alarm may also include a tamper switch for detecting the removal of the switch from the wall or other portion of the safe by an unauthorized person. The safe switch assembly may include other features to trigger alarms based on factors such as the design of the safe, the contents of the safe, or other characteristics drawing the thief's attention to the safe.

Some alarm systems operate in a normally closed configuration, in which current is always provided in a switch, and the alarm system is tripped when the current is interrupted. These setups are referred to as "normally closed". Others operate in a normally open configuration, in which current is not normally present in a switch, and the alarm system is tripped when current is present. These setups are referred to as "normally open". In addition, two-finger switches can be used to activate two separate aspects of the alarm system. For example, pressing one switch may activate a camera, while simultaneously pressing both switches may activate a silent alarm. The wiring to these different functions can be either both normally open, both normally closed, or one open and the other closed.

Based on the foregoing, it is clear that a variety of switch assemblies are used in a bank alarm system to protect different areas and devices of the bank. The same may be true for a home alarm system. Necessitating a unique switch assembly for each situation can lead to increase costs in design and manufacturing, thereby increasing the cost of the alarm system. For instance, a unique housing or case must be provided to enclose the specific switch assembly to ensure that the switches will be triggered upon the desired event (intrusion, depression of a button, etc.). Moreover, the housing must include suitable means for securing the switch assembly to the desired area (i.e. beneath a counter, on the interior of a safe, etc.).

Thus, a need exists for an improved switch assembly that is modular in design such that is may be adapted for use in a variety of situations. Ideally, such a switch assembly would be easy to manufacture, easy to install, and easy to replace. The present disclosure is directed to fulfilling these needs and others as described below.

SUMMARY

A switch assembly having a housing with a lower housing portion removably securable to an upper housing portion is provided. A switch subassembly including a printed circuit board (PCB) is removably secured within the lower housing portion. A mechanical switch assembly and a sensor are electrically connected to the PCB, and the PCB includes circuitry to place each of the mechanical switch assembly and the sensor into electrical communication with an external source. The switch assembly further includes a plunger engageable with the mechanical switch assembly.

An attachment assembly for securing the upper housing portion to a mounting structure includes a mounting plate securable to the mounting structure, wherein the mounting plate includes at least one threaded opening. At least one opening is formed in the upper housing portion that is alignable with the threaded opening in the mounting plate that is sized and configured to receive a fastener.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the disclosed subject matter will become more readily appreciated by reference to the following detailed description, when taken in conjunction with the accompanying drawings, wherein.

DETAILED DESCRIPTION

Figure 1:
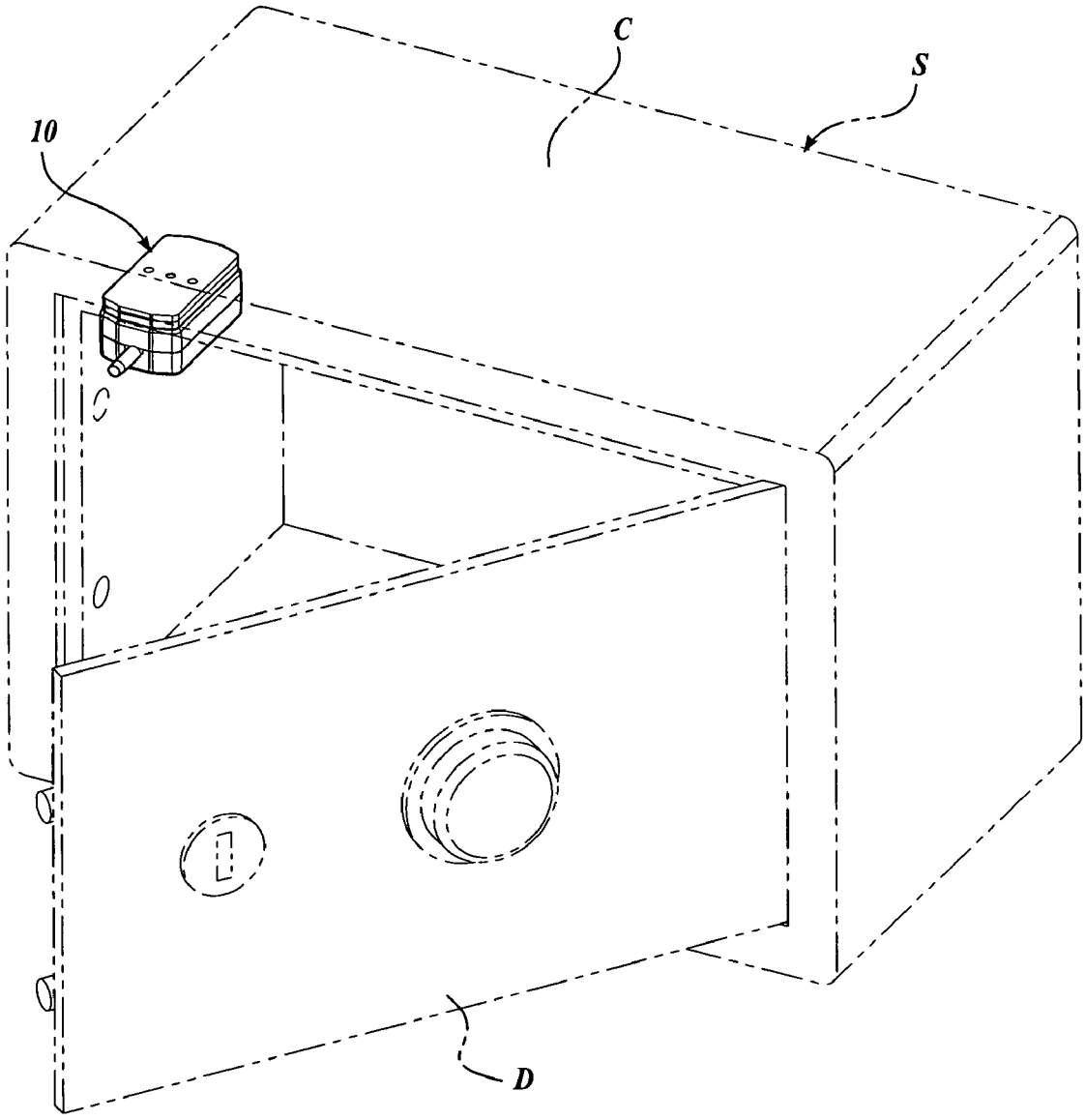
FIG. 1 is an isometric environmental view of a switch assembly formed in accordance with one embodiment of the present disclosure, wherein the switch assembly is shown mounted to the interior of a safe having a safe door.

A switch assembly 10 formed in accordance with one embodiment of the present disclosure can best be seen by referring to FIG. 1. Although the switch assembly 10 may be used in any suitable environment necessitating an alarm system, the switch assembly 10 will be hereinafter described as being used in a safe S having a safe door D. Thus, the following description and corresponding illustrations of the switch assembly 10 in use with a safe S should not be seen as limiting the scope of the present disclosure. The switch assembly 10 is shown secured to the interior upper surface, or ceiling C of the safe S such that a portion of the switch assembly 10 engages the safe door D when the door is closed. When the safe door D is opened, the door D eventually comes out of contact with the switch assembly 10 to trigger an alarm, notify an authority of the intrusion, activate a monitoring device, etc.

Figure 2:
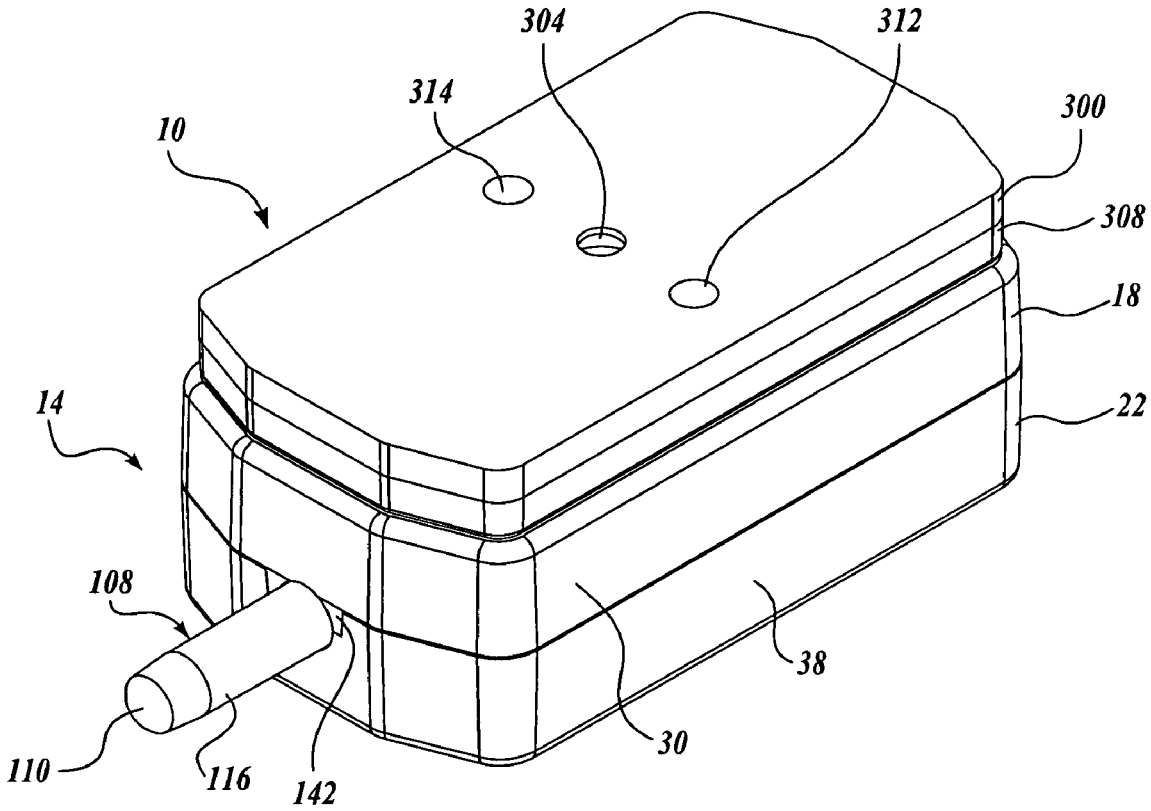
FIG. 2 is a top isometric view of the switch assembly of FIG. 1.
Figure 3:
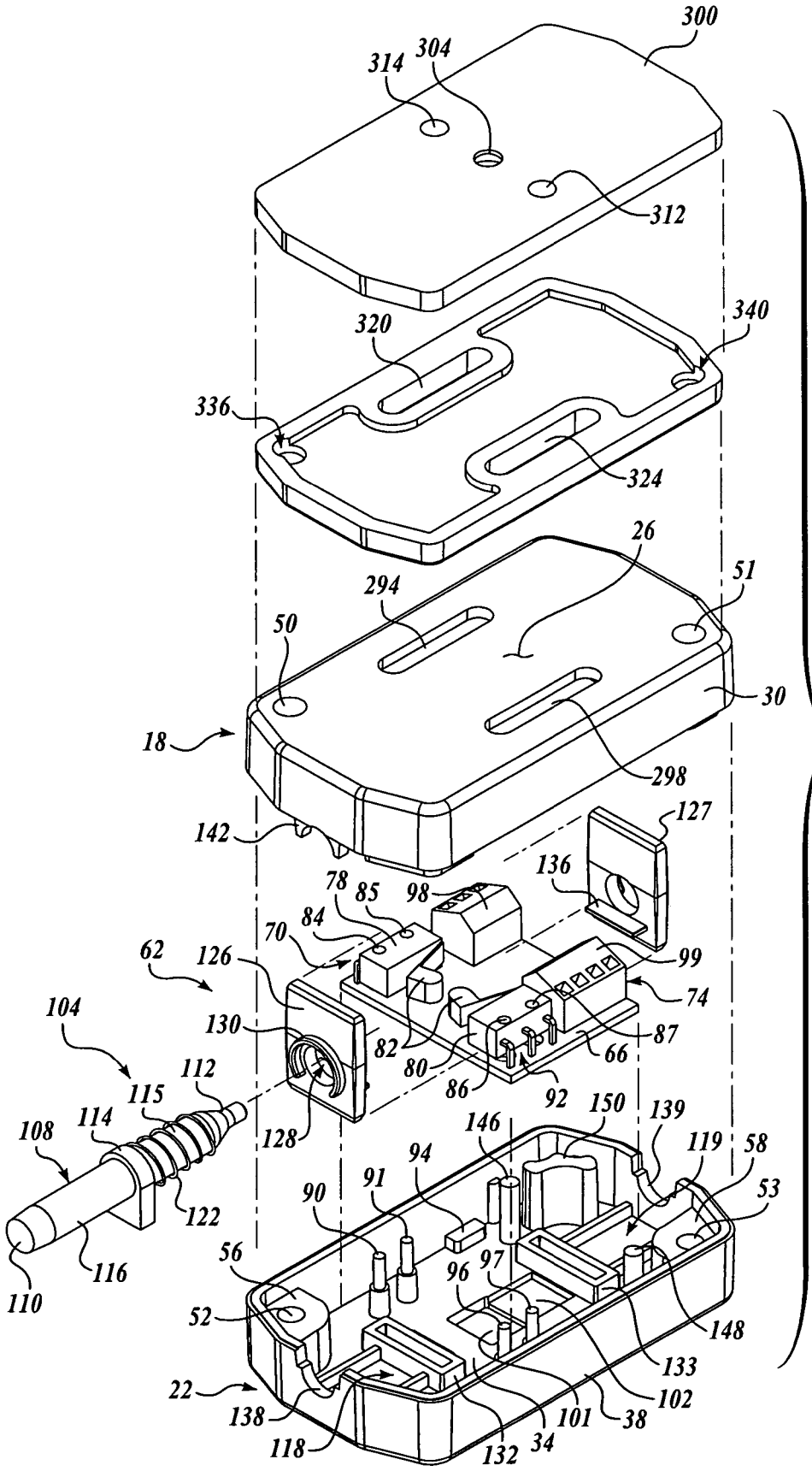
FIG. 3 is an exploded isometric view of the switch assembly of FIG. 1 shown from a first perspective.
Figure 4:
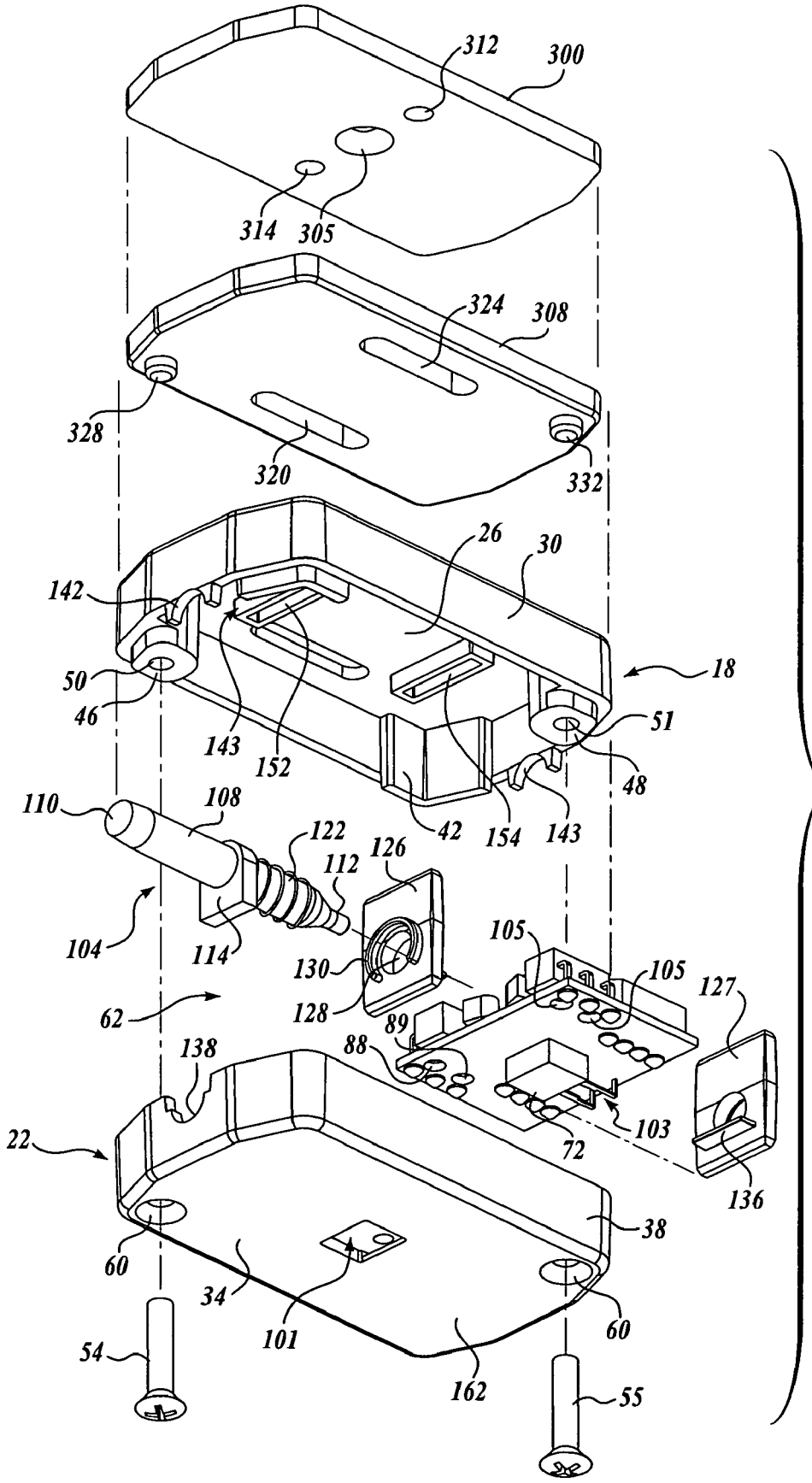
FIG. 4 is an exploded isometric view of the switch assembly of FIG. 1 shown from a second perspective.

Referring to FIGS. 2-4, a detailed description of the switch assembly 10 suitable for triggering an alarm upon an intrusion of the safe S will be hereinafter provided. The switch assembly 10 includes a housing 14 for enclosing the internal components of the switch assembly 10 and securing the switch assembly 10 to the interior ceiling C of the safe S. The housing 14 is substantially rectangular in shape and defines first and second ends. It should be appreciated that the housing 14 may instead be any suitable size and geometry to accommodate the internal components of the switch assembly 10 and to fit within the required dimensions or space requirements of the area in which the switch assembly 10 is being used.

Referring specifically to FIGS. 3 and 4, the housing 14 is defined by upper and lower housing portions 18 and 22 made from any suitable material in any suitable manner. For instance, the upper and lower housing portions 18 and 22 may be injection molded parts formed from a thermoplastic material or a high-impact plastic resin. The upper housing portion 18 defines a substantially flat attachment portion 26 and a upper outer edge portion 30 extending downwardly and transversely from the attachment portion 26 to define four rounded corners. The lower housing portion 22 similarly includes a substantially flat mounting portion 34 and a lower outer edge portion 38 extending upwardly and substantially transversely therefrom to define four rounded corners.

The upper and lower housing portions 18 and 22 are substantially identical in overall shape and size and mate together such that the exterior surface of the upper and lower outer edge portions 30 and 38 are substantially flush. Referring to FIG. 5, the upper housing portion 18 includes first and second mating flanges 40 and 42 formed at first and second opposite corners of the upper housing portion 18. The upper housing portion 18 further includes first and second fastener receiving protrusions 46 and 48 formed at third and fourth opposite corners of the upper housing portion 18. The flanges 40 and 42 and protrusions 46 and 48 extend downwardly from the interior surface of the attachment portion 26 along the interior surface of the upper outer edge portion 30. Moreover, the flanges 40 and 42 and protrusions 46 and 48 extend from the bottom edge of the upper housing portion 18 a predetermined amount such that they are receivable within the lower housing portion 22 when the upper and lower housing portions 18 and 22 are aligned and mated together. The mating flanges 40 and 42 and protrusions 46 and 48 abut against the interior surface of the lower outer edge portion 38 to define a snug fit between the upper and lower housing portions 18 and 22. In this manner, the upper and lower housing portions 18 and 22 may be temporarily held together during assembly.

The first and second fastener receiving protrusions 46 and 48 include openings 50 and 51 that are at least partially threaded in the bottom portion of the openings 50 and 51 for receiving a fastener therein, such as a screw or a bolt. For instance, the openings 50 and 51 may include a threaded insert received therein or may instead be molded to include threaded portions. The threaded openings 50 and 51 are alignable with unthreaded openings 52 and 53 formed in the lower housing portion 22. As such, fasteners 54 may be passed through openings 52 and 53 and threadably inserted within openings 50 and 51 to fixedly secure the lower housing portion 22 to the upper housing portion 18. The lower housing portion 22 may include countersinks formed around the openings 52 and 53 in the exterior surface of the mounting portion 34 such that countersunk screws or bolts may be used.

The unthreaded openings 52 may be defined within first and second fastener supports 56 and 58 formed in opposite corners of the lower housing portion 22. The supports 56 and 58 are alignable with and abut against the first and second fastener receiving protrusions 46 and 48 when the upper and lower housing portions 18 and 22 are mated together. The protrusions 46 and 48 and supports 56 and 58 surround the fastener to increase the shear strength of the fastener, thereby enhancing the structural support of the housing 14. In this manner, the upper and lower housing portions 18 and 22 are prevented from easily separating if, for instance, an intruder is tampering with and/or attempting to quickly dismantle the switch assembly by force or blow.

The upper and lower housing portions 18 and 22 are mated together in the manner set forth above to enclose mechanical and electrical internal components of the switch assembly 10. The mechanical and electrical components of the switch assembly 10, as well as any incoming wiring (not shown) and electrical connections provided between the components is generally referred to herein as a switch subassembly 62. Although the switch subassembly 62 may include any suitable arrangement of mechanical and electrical components to carry out the desired alarm function, the switch subassembly 62 will be hereinafter described as having components suitable for separately triggering alarms in response to the opening of the safe door D or the sensation of heat (if, for instance, an intruder is trying to destroy the lock with a torch or similar device). However, it should be appreciated that the upper and lower housing portions 18 and 22 may instead be used to enclose components suitable for carrying various other functions, such as dual pushbutton assembly for acting as a "two-finger switch."

Referring still to FIGS. 3 and 4, the switch subassembly 62 is disposed within the lower housing portion 22 such that it may be thereafter mated with the upper housing portion 18 to define the switch assembly 10. The switch subassembly 62 includes a printed circuit board (PCB) 66 suitably designed for electrically connecting a mechanical switch assembly 70 and a thermal sensor 72 to a quick disconnect assembly 74.

The quick disconnect assembly 74 includes first and second quick disconnect units 98 and 99 that are soldered to the PCB 66 and placed in electrical communication with circuitry of the PCB 66 in a manner well known in the art. The quick disconnect units 98 and 99 may be of any suitable design for placing the mechanical switch assembly 70 and the thermal sensor 72 into electrical communication with one or more external wires (not shown). For instance, PCB terminal blocks (Manufacturing Part Numbers 1751109 and 1751112) available from Phoenix Contact in Middletown, Pa. may be used. The first disconnect unit 98 may be placed into communication with a first external wire for triggering a first alarm in response activation of the mechanical switch assembly 70 and/or thermal sensor 72, and the second disconnect unit 99 may be placed into communication with a second external wire for triggering a second alarm in response activation of the mechanical switch assembly 70 and/or thermal sensor 72, or perhaps a third switch or sensor not shown.

The external wires provide a source of power to the PCB 66 and communicate signals to and from the first and second quick disconnect units 98 and 99. One of ordinary skill will recognize that the external wires may be connected to an any suitable internal or external power source, and they may communicate with alarm components wirelessly or through physical wires.

Optional wire guides 146, 148, and 150 may extend upwardly from the mounting portion 34 of the lower housing portion 22 to secure the external wire (not shown) within the lower housing portion 22 and route the wire to an opening in the housing 14. For instance, the external wire may exit the housing through an opening defined by a recess 139 in one end of the lower housing 22. It should be appreciated that the opening may be defined elsewhere in the housing 14 to appropriately position the external wire for connection to a portion of the alarm system. This may be required, for instance, if the recess 139 is needed to receive a plunger shaft, a pushbutton, or other mechanical actuator for activating the switch subassembly 60, as will be described in more detail below.

The mechanical switch assembly 70 includes first and second mechanical switches 78 and 80 mounted on the PCB 66. Although any suitable mechanical switch may be used, the switches are preferably a readily available known switch available from a variety of manufacturers, such as a Cherry™ DG Series sub-miniature snap-action switch, available from ZF Electronics Corporation in Pleasant Prairie, Wis. The switches preferably each include an auxiliary roller actuator 82 suitable to depress an actuator button (not shown) in an operational state; however, it should be appreciated that any other suitable actuator may be used. The switches 78 and 80 may be in either a normally open or closed state. For purposes of this description, the switches 78 and 80 are normally open and are closed by engaging the roller actuators 82 to depress the actuator button. In the closed state, no current is flowing through the circuit, and the alarm is set. The alarm is triggered when the actuators 82 move out of engagement with the actuator button.

Each mechanical switch 78 and 80 includes terminals 92 that are soldered into their respective openings in the PCB 66 and placed into electrical communication with a respective quick disconnect unit 98 and 99 of the quick disconnect assembly 74. In this manner, depression and release of the actuators 82 to close and open the mechanical switches 78 and 80 may set and trigger separate alarms (for instance, an audible alarm and a camera).

The thermal sensor 72 is mounted to the bottom of the PCB 66, as shown in FIG. 4, such that the thermal sensor 72 may be exposed through an opening 101 in the mounting portion 34 of the lower housing portion 22 when assembled. With the thermal sensor exposed through the opening 101, the thermal sensor 72 can easily detect heat, smoke, etc., when a device such as a torch is being used in an attempt to open the safe S. Any suitable thermal sensor having a predetermined threshold temperature for triggering the alarm may be used, such as an Airpax® 6700 Series thermostat. Moreover, the thermal sensor 72 is preferably normally open, and the circuit is closed upon the detection of heat at the predetermined threshold. The thermal sensor 72 includes terminals 103 soldered to the PCB 66 and placed into electrical communication with the second disconnect unit 99. The PCB 66 includes circuitry (see FIG. 6) that places the thermal sensor 72 into separate electrical communication with the second disconnect unit 98 such that either the thermal sensor 72 or the second mechanical switch 80 may trigger the alarm wired to the quick disconnect unit 98.

It should be appreciated that the switch subassembly 62 may instead include a third sensor or switch mounted on the PCB 66 that is electrically connected to either the first or second quick disconnect assembly 74 for triggering the same or different alarm in response to a third input (i.e. a motion sensor, chemical sensor, vibration sensor, sound sensor, etc.). In addition, the PCB 66 may instead be interchanged with another PCB 66 containing different or similar switch subassembly components.

The PCB 66 and the electrical and mechanical components mounted thereon is removably secured within the lower housing portion 22 preferably without the use of tools to allow for easy assembly and disassembly of the switch assembly 110. In this manner, if a portion of the switch subassembly 62 fails, the entire subassembly may be quickly replaced to bring the alarm system back into operating condition. The lower housing portion 22 is also modular in design such that the housing 14 may be used to enclose any similarly designed switch subassembly.

In particular, the PCB 66 is positioned within and mounted to the lower housing portion 22 of the housing through a plurality of stand-offs or protrusions extending upwardly from the interior mounting portion 34 that are engageable with or received within portions of the PCB 66 and its components. For instance, first, second, third, and fourth switch mounting posts 90, 91, 96, and 97 extend upwardly and are receivable within respective openings 88, 89, 105, and 106 formed in the PCB 66 as well as aligned, respective openings 84, 85, 86, and 87 defined in each of the mechanical switches 78 and 80. In this manner, the mounting posts 90, 91, 96, and 97 position and secure the PCB 66 within the lower housing portion 22.

The mounting posts 90, 91, 96, and 97 further each include an enlarged portion that defines a shoulder for engaging the bottom surface of the PCB 66. Moreover, at least one stand-off 94 may be formed on the interior mounting portion 34 of the lower housing portion 22 that is likewise engageable with the bottom surface of the PCB 66. The mounting posts 90, 91, 96, and 97 and stand-offs 94 vertically position the PCB 66 within the lower housing portion such that the thermal sensor 72 is substantially flush with the exterior surface of the mounting portion 34 when received within the opening 101 in the lower housing portion 22. As such, the thermal sensor 72 may not be easily removed or otherwise tampered with by an intruder. A recess 97 may be formed within the mounting portion 34 of the lower housing portion 22 to receive the terminals 103 of the thermal sensor 72.

The PCB 66 is also appropriately positioned vertically within the lower housing portion 22 such that the actuators 82 of the mechanical switches 78 and 80 are actuatable by a plunger assembly 104. As can best be seen by referring to FIG. 3, the plunger assembly 104 includes a plunger shaft 108 partially receivable within an opening in the housing 14 to define an interior shaft portion 115 and an exterior shaft portion 116. The opening is defined by a recess 138 formed in one end of the lower outer edge portion 38 of the lower housing portion 22 and a corresponding crescent-shaped protrusion 142 extending downwardly from the upper outer edge portion 30 of the upper housing portion 18. The crescent-shaped protrusion 142 is received within a portion of the recess 138 to define a substantially circular opening for slidably receiving the plunger shaft 108.

The exterior shaft portion 116 of the plunger shaft 108 defines a protruding end 110 that extends outwardly from the housing 14, and the interior shaft portion 115 defines a tapered end 112 that extends into the opening in the housing 14. The tapered end 112 is engageable with the actuators 82 of the mechanical switches 78 and 80 as the plunger shaft 108 is moved into the housing 14. In this manner, the plunger shaft 108 can be used to activate the mechanical switches 78 and 80 when the shaft 108 is moved into the housing 14 by, for instance, depressing the protruding portion 110 of the shaft.

To ensure that the plunger shaft 108 maintains axial alignment and moves in a linear fashion to properly engage the actuators 82, the plunger assembly 104 may further include an alignment assembly (not numbered for clarity). The alignment assembly may include a plunger guide 114 that is formed on or otherwise connected to the plunger shaft 108, preferably around the mid-portion of the shaft 108 or between the interior and exterior shaft portions 115 and 116. The plunger guide 114 extends downwardly from the shaft 108 to define a substantially square end that is sized and shaped to be slidably receivable within a track 118 defined on the interior surface of the mounting portion 34 in the lower housing portion 22. The track 118 may be formed in any suitable manner. For instance, the track 118 may be defined by two substantially parallel upwardly extending protrusions, or the track 118 may instead be defined by a recess formed within the mounting portion 34 in the lower housing portion 22. In any event, the plunger guide 114 is slidable within the track 118 to ensure axial, linear movement of the plunger shaft 108 into the housing 14.

The alignment assembly may further include a first plunger support 126 that extends between the attachment portion 26 and the mounting portion 34 of the upper and lower housing portions 18 and 22. The first plunger support 126 is tightly receivable within first and second plunger support receptacles 152 and 132 formed on the attachment portion 26 and the mounting portion 34, respectively, such that the first plunger support 126 is substantially transverse to the attachment portion 26 and the mounting portion 34. The first plunger support 126 includes a plunger guide hole 128 sized and configured to slidably receive the plunger shaft 108 therein. The first plunger support 126 is positioned adjacent to the PCB 66 such that the lower outer edge 38 of the lower housing portion 22 and the first plunger support 126 act as first and second supports to maintain the axial alignment of the plunger shaft 108 and ensure substantially linear movement.

A second alignment assembly may be provided on the opposite end of the housing 14 in the event that a second plunger assembly (not shown) is needed. For instance, the exterior shaft portion 116 each plunger assembly may be truncated to define a pushbutton for a two-finger switch assembly. The second alignment assembly may similarly include a recess 119 for receiving a plunger guide, and third and fourth plunger support receptacles 133 and 154 for receiving a second plunger support 127.

Each plunger support 126 and 127, when received within receptacles 132, 152, 133, and 154, also add support and structural stability to the housing 14. The first and second plunger supports 126 and 127 each further include a PCB flange 136 that extends outwardly and substantially transversely the supports 126 and 127 to engage the upper surface of the PCB 66. In this manner, the plunger supports 126 and 127 help secure the PCB 66 in its position when the supports 126 and 127 are tightly received within receptacles 132 and 133 and are further received within receptacles 152 and 154 when the lower housing portion 22 is mounted to the upper housing portion.

The plunger assembly 104 further includes a biasing member to urge the plunger shaft 108 out of engagement with the actuators 82 of the mechanical switches 78 and 80, thereby leaving the switches 78 and 80 in a normally open state. Any suitable biasing member may be used. For instance, an extension coil spring 122 may be axially disposed on the plunger shaft 108 between the plunger guide 114 and the tapered end 112. The spring 122 is engageable with both the plunger guide 114 and the plunger support 126 to impart a force against the plunger guide 114 and maintain the plunger shaft 108 in an extended position. An arcuate protrusion 130 may be formed around the opening 128 in the plunger support 126 that is sized and configured to receive an end of the spring 122 thereon to help maintain the axial alignment of the spring 122 on the plunger shaft 108.

Still referring to FIGS. 3 and 4, the manner in which the switch assembly 10 is assembled and mounted to the safe S will be hereinafter described. Although the preferred method of assembly will be hereinafter provided, it should be appreciated that any other assembly or attachment method that appreciates the benefits of the present design may also be used without departing from the scope of the present disclosure.

To assembly the switch assembly 10, the PCB 66 and its electrical and mechanical components are first disposed within the lower housing portion 22 by engaging the PCB 66 with the mounting posts 90, 91, 96, and 97 and stand-offs 94 as described above. The plunger supports 126 and 127 are thereafter received within receptacles 132 and 133 until the PCB flange 136 of each support engages the upper surface of the PCB 66. In this manner, the PCB 66 is firmly secured and properly positioned within the lower housing portion 22.

After securing the PCB 66 within the lower housing portion 22, the plunger assembly 104 may be secured within the lower housing portion 22 in any suitable manner. For instance, the spring 122 may first be secured on the plunger shaft 108, and the interior shaft portion 115 may then be slide into the opening 128 of the plunger support 126 such that the plunger guide 114 is received within the plunger track 118. In the alternative, the interior shaft portion 115 of the plunger shaft 108 may instead be inserted into the opening 128 of the plunger support 126 before the support 126 is disposed within receptacle 132. In any event, the end of the coil spring 122 may be thereafter secured on the annular protrusion 130 such that the plunger assembly 104 is ready for use in its biased, extended position.

With the switch subassembly 60 received within the lower housing portion 22, the lower housing portion 22 is now ready to be secured to the upper housing portion 18. However, for ease of installation, it is preferred the that upper housing portion 18 first be secured to the ceiling C of the safe S (or any other preferred area). Referring to FIGS. 3 and 4, the upper housing portion 18 is preferably secured to the ceiling C with a mounting plate 300. The mounting plate 300 is preferably made from a strong and durable material, such as stainless steel or another metal. The mounting plate substantially corresponds in shape and size to the attachment portion 26 of the upper housing portion 18. Moreover, the mounting plate includes a countersunk hole 305 suitable for receive a fastener, such as a countersunk screw, such that the upper housing portion 18 may be mounted substantially flush against the mounting plate 300. The mounting plate 300 is easily secured to the ceiling C by drilling a single fastener through the hole 305 into the ceiling C. It should be appreciated that the mounting plate 300 may instead be secured to the ceiling C in any other suitable manner, such as by welding.

The mounting plate 300 further includes first and second threaded openings 312 and 314 that are suitable to receive a fastener, such as a screw or bolt. The openings 312 and 314 are alignable with slots 294 and 298 formed in the attachment portion 26 of the upper housing portion 18. First and second fasteners (not shown) may be passed through the slots 294 and 298 and adjustably positioned within the slots to thread the fasteners into openings 314 and 312. In this manner, the upper housing portion 18 may be easily secured to the mounting plate 300 without having to drill holes in the ceiling C. Thus, it may be appreciated that the mounting plate 300 facilitates easy removal of and replacement of the switch assembly 10 within the safe S.

After securing the upper housing portion 18 to the mounting plate 300, the lower housing portion 22 may be thereafter secured to the upper housing portion 18 by first temporarily mating the upper and lower housing portions 18 and 22 together, as described above. Fasteners 54 and 55 are thereafter passed through openings 52 and 53 in the lower housing portion 22 and are threadably received into the threaded portions of openings 50 and 51 in the upper housing portion 18. As such, the housing 14 is secured to the ceiling of the safe and the upper and lower housing portions 18 and 22 are secured together to enclose the switch subassembly 60.

As shown in FIG. 1, the switch assembly 10 is secured to the ceiling C such that the plunger shaft 108 is engageable with the safe door D. If adjustment in the vertical position of the switch assembly 10 is needed for the plunger shaft 108 to engage the door D, one or more stackable spacers 308 may be disposed between the upper housing portion 18 and the mounting plate 300 during assembly (see also FIG. 2).

Referring to FIGS. 3 and 4, each stackable spacer 308 substantially corresponds in shape and size to the attachment portion 26 of the upper housing portion 18. Moreover, the stackable spacer 308 includes slots 320 and 324 that are substantially alignable with the slots 294 and 298 of the upper housing portion 18 such that the fasteners may pass therethrough. Further, the stackable spacers 308 include protrusions 328 and 332 formed in each corner that extend downwardly from the lower surface of the spacer such that they are receivable within the non-threaded portions of openings 50 and 51 in the upper housing portion 18. In this manner, the stackable spacer 308 may be temporarily secured on the upper housing portion 18 while the upper housing portion 18 is being secured to the mounting plate 300. In the event that more than one stackable spacer 308 is needed, cavities 336 and 340 are formed in each corner of the spacer on the upper surface to correspond to the protrusions 328 and 332. As such, a second stackable spacer may be placed atop a first spacer, and the protrusions 328 and 332 of the second spacer 308 may be received within the cavities 336 and 340 of the first spacer.

Once the switch assembly 10 is assembly and properly positioned and mounted within the safe S, the switch assembly 10 acts as an alarm for the safe S by triggering a switch either when the door D is opened to disengage the plunger shaft 108 or when heat is sensed by the thermal sensor 72.

Figure 5A:
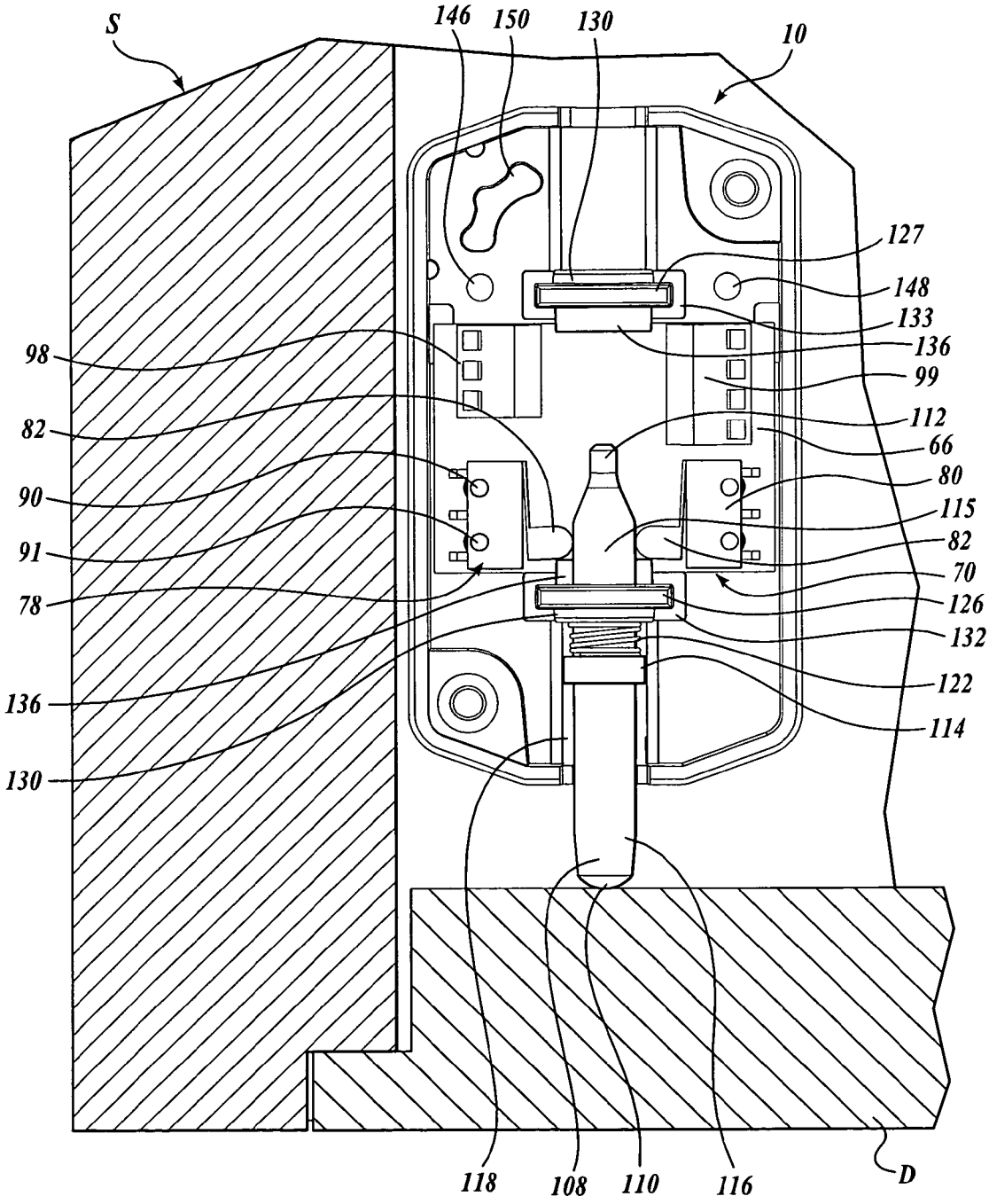
FIG. 5A is a planar, partial cross-sectional view of the switch assembly of FIG. 1 shown in a safe with the safe door closed, wherein a top portion of the switch assembly has been removed for clarity.
Figure 5B:
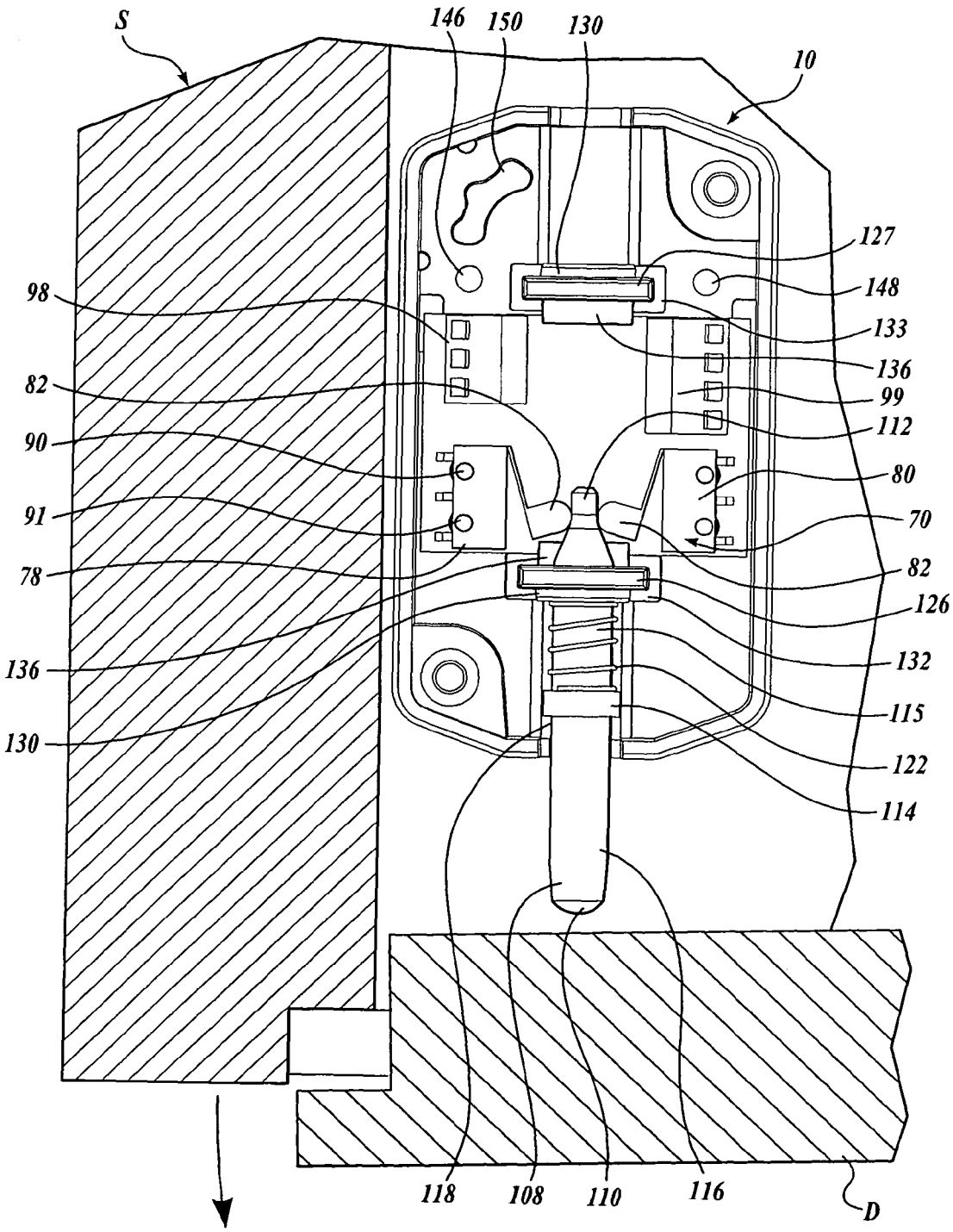
FIG. 5B is a planar, partial cross-sectional view of the switch assembly of FIG. 1 shown in a safe with the safe door open, wherein a top portion of the switch assembly has been removed for clarity.

Referring to FIGS. 5A and 5B, operation of the switch assembly 10 within the safe will be hereinafter described. FIG. 5A shows the safe door D in a closed position and therefore engaging the protruding plunger end 110. The door D depresses the plunger shaft 108 and urges the shaft into the housing 14. As the plunger shaft 108 moves into the housing 14, actuators 82 of each switch 78 and 80 are forced away from the plunger shaft 108 toward their respective switch by the tapered plunger end 112. When the non-tapered interior shaft portion 115 is received between the actuators 82, the actuators are forced into engagement with a the actuator button of the switch (not shown) and cause the switches 78 and 80 to close. With the switches 78 and 80 closed, no current is allowed to flow through the switch 210 causing the alarm to be set. As noted above, only one of the switches 78 and 80 must be actuated to set the alarm. The other switch may be used to set a different type of alarm, such as a monitoring camera.

As the plunger shaft 108 is pushed into the housing 14, the spring 122 compresses and produces a biasing force in the direction opposite the actuators 82. Thus, referring to FIG. 5B, when the safe door D is opened, the compressed spring 122 urges the plunger shaft 108 in a direction opposite the actuators 82, or out of the housing 14. More specifically, as the plunger shaft 108 moves out of the housing 14, the actuators 82 move along the shaft 108 down the tapered end portion 112. When the ends of the actuators 82 have moved sufficiently far down the tapered portion 112, the actuators 82 disengage the actuator buttons of the switches 78 and 80, thereby opening the switches and allowing current to flow. The current flows to quick disconnect units 98 and 99 and out through the external wire (not show) to trigger the corresponding alarm.

The switch assembly 10 is preferably mounted near the end of the safe door D furthest away from the hinge of the door, as seen in FIG. 1. Mounting the switch assembly 10 in such a location will allow the plunger shaft 108 to move out from within the housing 14 as the safe door D is only slightly opened, as seen in FIG. 5B. If the switch assembly 10 is mounted closer to the hinge of the safe door, the safe door will have to be opened wider than is shown in FIG. 5B to allow the plunger shaft 108 to move out of engagement with the actuators 82 of the switches 78 and 80. Thus, the wider the opening, the greater the chance that the contents of the safe S may be removed without the switch assembly 10 triggering an alarm.

The switch assembly 10 may also trigger an alarm when heat is sensed by the thermal sensor 72. For instance, if an intruder is attempting to cut into the safe 100 with a blow torch or other heat cutting device, the temperature inside the safe rises. When the temperature rises above the threshold temperature of the thermal sensor 72, the sensor 72 sends a signal through the power disconnect unit 99 to the external wire to trigger the corresponding alarm. One of ordinary skill will recognize that although a thermal sensor is described, the sensor 72 may be any kind of sensor used to detect unauthorized access to the safe. Examples may include, a motion sensor, chemical sensor, vibration sensor, sound sensor, or the like.

Figure 6:
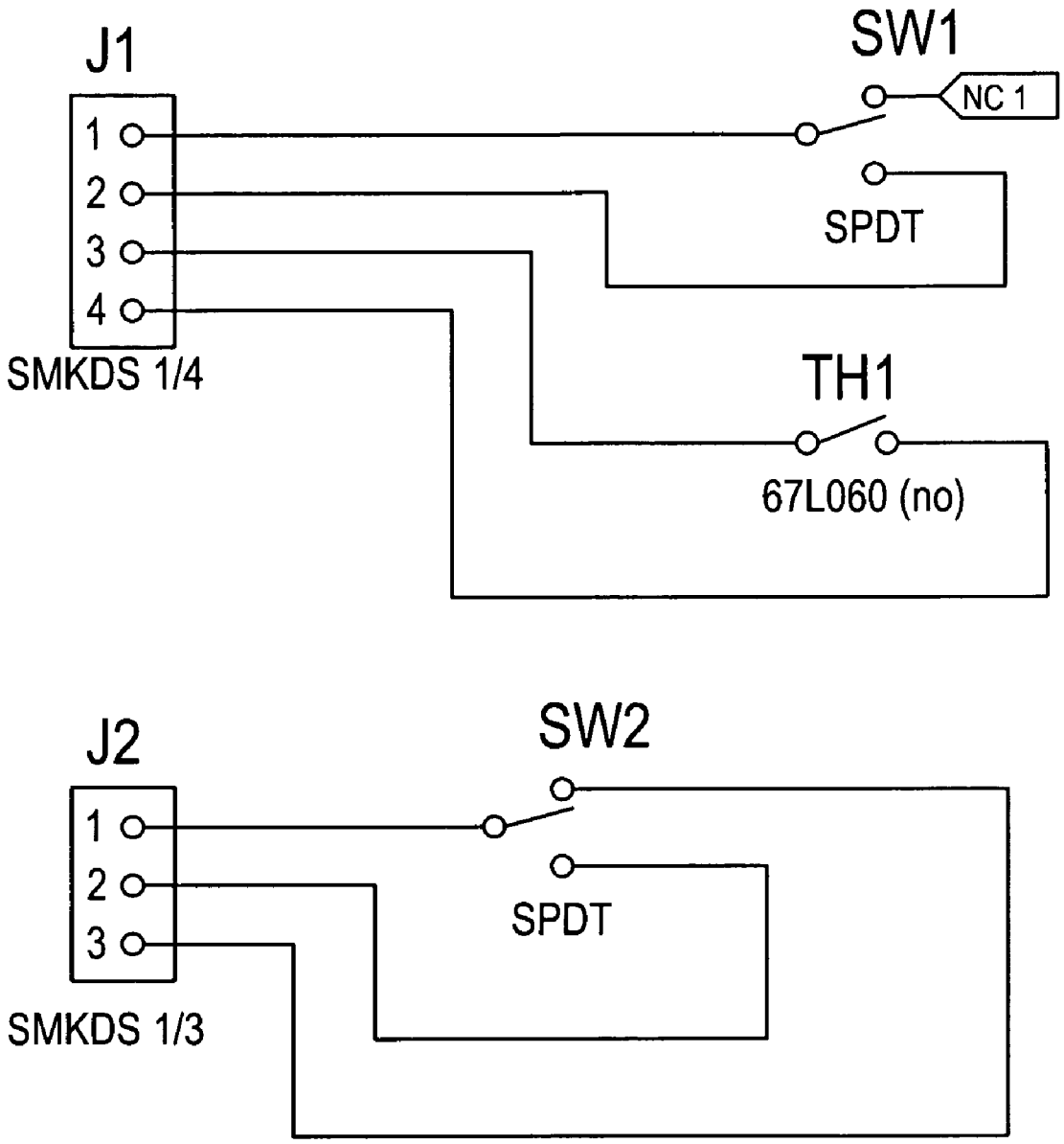
FIG. 6 is a diagram illustrating one embodiment of an electrical schematic and layout for a printed circuit board of the switch assembly of FIG. 1.

Referring to FIG. 6, an exemplary electrical schematic and layout for the PCB 66 of the switch subassembly 62 is provided. It should be appreciated that the layout is provided for illustrative purposes only, and any other suitable layout may instead be used. Moreover, the electrical schematic may be used with alarm systems that are normally open or closed.

In FIG. 6 the first and second mechanical switches 78 and 80 are labeled SW2 and SW1, respectively. The thermal sensor is labeled TH1, and the first and second quick disconnect units 98 and 99 are labeled J2 and J1, respectively. Each quick disconnect unit J2 and J1 includes three and four terminals, respectively, labeled 1-3 and 1-4. As can be seen, the first mechanical switch SW1 and the thermal sensor TH1 are electrically connected to the second quick disconnect unit J1, with SW1 being in a normally closed state (when in use inside the safe) and TH1 being in a normally open state. Switch SW1 and thermal sensor TH1 may open or close independently to separately trigger the corresponding alarm through the quick disconnect unit J1.

The second mechanical switch SW2 is connected to the first disconnect unit J2 through a separate electrical circuit. Thus, as noted above, the switch SW2 may be used to trigger an auxiliary alarm, such as a monitoring camera or another device, when the second switch 80 is opened. Moreover, a second sensor, such as a motion sensor, vibration sensor, etc., may be added to the circuit to independently trigger the alarm upon sensing the proper event.

While illustrative embodiments have been illustrated and described, it will be appreciated that various changes can be made therein without departing from the spirit and scope of the disclosed subject matter.

The embodiments of the present disclosure in which an exclusive property or privilege is claimed are defined as follows:

1. A switch assembly, comprising:

(a) a housing having a lower housing portion removably securable to an upper housing portion;

(b) a switch subassembly receivable within the lower housing portion, the switch subassembly comprising a printed circuit board removably secured within the lower housing portion, the switch subassembly further comprising a mechanical switch assembly and a sensor electrically connected to the printed circuit board, wherein the printed circuit board includes circuitry to place each of the mechanical switch assembly and the sensor into electrical communication with an external source;

(c) a plunger support removably receivable within a receptacle defined within the lower housing portion, the plunger support having a flange extending outwardly from the plunger support that is selectively engageable with a top surface of the printed circuit board to removably secure the printed circuit board within the lower housing portion such that the printed circuit board is positioned substantially parallel to the bottom surface of the lower housing portion; and (d) a plunger engageable with the mechanical switch assembly; and (e) an attachment assembly for securing the upper housing portion to a mounting structure, the attachment assembly comprising:

(i) a mounting plate having at least one threaded opening, the mounting plate securable to the mounting structure; and (ii) at least one opening formed in the upper housing portion that is alignable with the threaded opening in the mounting plate and that is sized and configured to receive a fastener.

2. The switch assembly of claim 1, wherein the at least one opening formed in the upper housing is a slot configured to adjustably receive a fastener.

3. The switch assembly of claim 1, wherein the attachment assembly further comprises at least one spacer mateable with the housing and disposable between the upper housing portion and the mounting plate, the spacer having at least one opening that is alignable with the opening in the upper housing portion.

4. The switch assembly of claim 1, wherein the sensor is positioned on the printed circuit board such that it is receivable within an opening in the lower housing portion.

5. The switch assembly of claim 1, wherein the sensor is a thermal sensor.

6. The switch assembly of claim 1, further comprising an alignment assembly for maintaining the plunger in substantial linear alignment, the alignment assembly comprising a plunger guide extending from the plunger, the plunger guide slidably receivable within a plunger track formed within the bottom portion of the housing.

7. The switch assembly of claim 6, wherein the plunger support extends between the upper and lower housing portions to provide structural stability to the housing.

8. The switch assembly of claim 7, wherein a biasing member is engageable with a portion of the plunger to bias the plunger out of engagement with the mechanical switch assembly.

9. The switch assembly of claim 8, wherein the plunger support includes an annular protrusion sized and configured to receive a portion of the biasing member to position the biasing member on the plunger.

10. The switch assembly of claim 1, wherein the plunger is removably receivable within an opening defined in the plunger support to removably secure the plunger within the housing.

11. A switch assembly configured to trigger an alarm upon the activation of at least one switch assembly component, the switch assembly comprising:

(a) a housing having a lower housing portion removably securable to an upper housing portion;

(b) a switch subassembly receivable within the lower housing portion, the switch subassembly comprising:

(i) a printed circuit board removably secured within the lower housing portion;

(ii) a mechanical switch assembly electrically connected to the printed circuit board;

(iii) a sensor electrically connected to the printed circuit board and positioned on the printed circuit board such that it is received within an opening in the bottom portion of the housing; and (iv) a quick disconnect assembly electrically connected to the printed circuit board and in electrical communication with the mechanical switch assembly and the sensor, the quick disconnect assembly configured to independently electrically connect the mechanical switch assembly and the sensor to an external source; and (v) a plunger support removably receivable within a receptacle defined within the lower housing portion, the plunger support having a flange extending outwardly from the plunger support that is selectively engageable with a top surface of the printed circuit board to removably secure the printed circuit board within the lower housing portion such that the printed circuit board is positioned substantially parallel to the bottom surface of the lower housing portion;

(vi) a plunger engageable with the mechanical switch assembly, the plunger moveable between a first engaged position, wherein the mechanical switch assembly is in a first state, and a second disengaged position, wherein the mechanical switch assembly is in a second state; and (c) an attachment assembly for removably securing the upper housing portion to a mounting structure.

12. The switch assembly of claim 11, wherein the sensor is one of a thermal sensor and a motion sensor.

13. The switch assembly of claim 11, wherein the mechanical switch assembly is closed in the first state such that no electrical current is flowing between the mechanical switch assembly and the quick disconnect assembly.

14. The switch assembly of claim 11, wherein the mechanical switch assembly is open in the second state such that electrical current is flowing between the mechanical switch assembly and the quick disconnect assembly to electrically connect the mechanical switch assembly with the external source.

15. The switch assembly of claim 14, wherein the external source is an alarm that is triggered when the mechanical switch assembly is in the second state.

16. The switch assembly of claim 11, wherein the external source is an alarm that is triggered upon receiving a signal from one of the mechanical switch assembly and the sensor.

17. The switch assembly of claim 11, further comprising an alignment assembly for maintaining the plunger in substantial linear alignment, the alignment assembly comprising a plunger guide extending from the plunger, the plunger guide slidably receivable within a plunger track formed within the bottom portion of the housing.

18. The switch assembly of claim 17, wherein the plunger support extends between the upper and lower housing portions to provide structural stability to the housing.

19. The switch assembly of claim 11, wherein the attachment assembly comprises:

(a) a mounting plate having at least one threaded opening, the mounting plate securable to the mounting structure; and (b) at least one opening formed in the upper housing portion that is alignable with the threaded opening in the mounting plate and that is sized and configured to receive a fastener.

20. The switch assembly of claim 19, wherein the attachment assembly further comprises at least one spacer mateable with the housing and disposable between the upper housing portion and the mounting plate, the spacer having at least one opening that is alignable with the opening in the upper housing portion.

* * * * *